US009571929B2

(12) United States Patent
Lee

(10) Patent No.: US 9,571,929 B2
(45) Date of Patent: Feb. 14, 2017

(54) SOUND ACCESSORY DEVICE AND OPERATING METHOD THEREOF

(71) Applicant: LG ELECTRONICS INC., Seoul (KR)

(72) Inventor: Jaekyung Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 30 days.

(21) Appl. No.: 14/591,719

(22) Filed: Jan. 7, 2015

(65) Prior Publication Data

US 2015/0201275 A1 Jul. 16, 2015

(30) Foreign Application Priority Data

Jan. 13, 2014 (KR) ..... 10-2014-0003899

(51) Int. Cl.

| | |
|---|---|
| ***H04R 3/00*** | (2006.01) |
| ***H04R 1/10*** | (2006.01) |
| ***H04R 1/40*** | (2006.01) |
| ***H04R 5/04*** | (2006.01) |

(52) U.S. Cl.

CPC ..... *H04R 3/00* (2013.01); *H04R 1/1041* (2013.01); *H04R 1/1083* (2013.01); *H04R 1/406* (2013.01); *H04R 5/04* (2013.01); *H04R 2201/107* (2013.01); *H04R 2420/01* (2013.01); *H04R 2420/07* (2013.01); *H04R 2430/00* (2013.01); *H04R 2430/01* (2013.01); *H04R 2430/20* (2013.01)

(58) Field of Classification Search

CPC ..... H04R 1/1041; H04R 3/00; H04R 1/1083; H04R 1/406; H04R 5/04; H04R 2201/107; H04R 2430/00; H04R 2420/07; H04R 2430/01; H04R 2430/20; H04R 2420/01

USPC ..... 381/74, 57, 71.1–71.8, 102, 104, 94.1,381/93, 95, 96

See application file for complete search history.

(56) References Cited

U.S. PATENT DOCUMENTS

| | | | | |
|---|---|---|---|---|
| 8,189,803 | B2 * | 5/2012 | Bergeron | G10K 11/178 381/123 |
| 9,050,212 | B2 * | 6/2015 | Gauger, Jr. | A61F 11/14 |
| 2001/0046304 | A1 * | 11/2001 | Rast | H04R 1/1041 381/74 |
| 2006/0153394 | A1 * | 7/2006 | Beasley | G10K 11/178 381/57 |
| 2008/0101638 | A1 * | 5/2008 | Ziller | H04M 1/6058 381/334 |

(Continued)

FOREIGN PATENT DOCUMENTS

| | | |
|---|---|---|
| EP | 2661097 | 11/2013 |

OTHER PUBLICATIONS

European Patent Office Application Serial No. 14199702.3, Search Report dated Jun. 17, 2015, 7 pages.

*Primary Examiner* — David Ton

(74) *Attorney, Agent, or Firm* — Lee, Hong, Degerman, Kang & Waimey

(57) ABSTRACT

A sound accessory device is provided. A receiving unit of the sound accessory device receives a first sound from a first external device. A sound output unit outputs a first sound. A sensing unit senses a second sound for triggering an output control of the first sound from outside. A control unit controls the output of the first sound, if the second sound is received. The sound for triggering the output control of the first sound includes at least any one selected from a specific word, a voiceprint representing a speech of a specific person, a horn of a vehicle, an alarm sound, a notification sound of an external device, a sound of an animal, and a doorbell sound.

12 Claims, 7 Drawing Sheets

| SECOND SOUND | SOUND OUTPUT CONTROL |
|---|---|
| BABY' S CRYING SOUND | OUTPUT ONLY SECOND SOUND |
| CRYING SOUND OF PET | OUTPUT SIMULTANEOUSLY SECOND SOUND WITH FIRST SOUND RECEIVED FROM EXTERNAL DEVICE |
| DOORBELL SOUND | STOP OUTPUT OF FIRST SOUND |

(56) References Cited

U.S. PATENT DOCUMENTS

| | | | | |
|---|---|---|---|---|
| 2010/0105331 | A1 | 4/2010 | Buehler et al. | |
| 2014/0126734 | A1* | 5/2014 | Gauger, Jr. ..... | H04R 3/002<br>381/71.6 |

* cited by examiner 30
205
200

| SECOND SOUND | SOUND OUTPUT CONTROL |
|---|---|
| BABY' S CRYING SOUND | OUTPUT ONLY SECOND SOUND |
| CRYING SOUND OF PET | OUTPUT SIMULTANEOUSLY SECOND SOUND WITH FIRST SOUND RECEIVED FROM EXTERNAL DEVICE |
| DOORBELL SOUND | STOP OUTPUT OF FIRST SOUND |

SOUND ACCESSORY DEVICE AND OPERATING METHOD THEREOF

CROSS-REFERENCE TO RELATED APPLICATIONS

Pursuant to 35 U.S.C. §119(a), this application claims the benefit of earlier filing date and right of priority to Korean Patent Application No. 10-2014-0003899, filed on Jan. 13, 2014, the contents of which are hereby incorporated by reference herein in its entirety.

BACKGROUND

The present disclosure relates to a sound accessory device connected to an external device and outputting a first sound received from the external device and an operating method thereof, and particularly, pertains to receive a second sound which is different from the first sound and control an output of the first sound on the basis of the second sound.

A sound accessory device is a device for receiving a sound signal from an external device, amplifying the sound signal, and outputting the amplified sound signal, and includes a headphone, a headset, and an earphone, etc. Many users experience high quality sound and use sound accessory devices for listening to music freely from external noise.

Furthermore, various sound accessory devices provide a function of canceling noise and enable the users to be absorbed in sounds output from the sound accessory devices.

However, if using these sound accessory devices, the user may not be sensitive to an external sound. Accordingly, the user may have a risk to miss a signal or sound necessary for the user. For example, if wearing a headphone and listening to music while crossing the road, the user may be put in danger since he or she does not hear honk of a vehicle approaching at a rapid speed. Due to this, traffic accidents frequently occur. Furthermore, if listening to music through a sound accessory, the user may not listen to an alarm sound from another device that is not connected to the sound accessory. For example, if sitting in a living room while listening to music by connecting a headphone to a mobile phone, the user may not hear an alarm from a washer or a micro oven in a kitchen. Furthermore, if connecting a sound accessory device to a TV and listening to music, the user may not hear his or her mobile phone ringing and may miss an important call.

In this way, due to use of a sound accessory device, there is an issue that the user does not hear external sound necessary for the user as well as noises. Therefore, a sound accessory device is necessary for addressing the issues.

SUMMARY

Embodiments are to prevent a user from not hearing a second sound including a car horn sound, a doorbell sound, or a mobile phone ringing sound that is necessary for the user, since the user uses a sound accessory device connected to an external device and outputting first sound received from the external device.

Embodiments provide a sound accessory device receiving a second sound necessary for a user and efficiently delivering the second sound to the user and an operating method of the sound accessory device.

In detail, embodiments also provide a sound accessory device receiving a second sound necessary for a user and controlling a sound's volume of first sound output, and stop and start of the first sound output on the basis of the second sound, and an operating method of the sound accessory device.

In detail, embodiments also provide a sound accessory device detecting a direction of a sound source which generates the second sound necessary for a user and outputting not only the second sound but also the direction of the sound source that generates the second sound, and an operating method of the sound accessory device.

In detail, embodiments also provide an operating method of a sound accessory device that receives a second sound necessary for a user, establishes a connection to the external device generating the second sound on the basis of the second sound, and releasing the connection with external device.

In one embodiment, a sound accessory device includes: a receiving unit receiving a first sound from a first external device and receiving a second sound for triggering an output control of the first sound from outside; a sound output unit outputting the first sound; and a control unit controlling the output of the first sound, if the second sound is received, wherein the sound for triggering the output control of the first sound comprises at least any one selected from a specific word, a voiceprint representing a speech of a specific person, a horn of a vehicle, an alarm sound, a notification sound of an external device, a sound of an animal, and a doorbell sound.~

The control unit may stop the output of the first sound, if the receiving unit receives the second sound.

The control unit may output the second sound simultaneously with the first sound, if the receiving unit receives the second sound. In addition, an output volume of the second sound may be greater than that of the first sound.

At this point, the control unit may release a connection with the first external device and establish a connection with the second external device outputting the second sound, if the receiving unit receives the second sound.

At this point a sensing unit may sense a direction of a sound source generating the second source and the control unit may output the direction of the sound source.

In another embodiment, an operating method of a sound accessory device, includes: receiving a first sound from a first external device; outputting the first sound; receiving a second sound for triggering an output control of the first sound output from outside; and controlling the output of the first sound.

An embodiment provides a sound accessory device that receives an external sound and efficiently transfers it to a user and an operating method of the sound accessory device. Through this, the user can the external sound that is necessary for him/her without surrounding noises while using the sound accessory device. For example, the user can hear a ringtone of a mobile terminal while watching a TV by using the sound accessory device.

In addition, an embodiment provides a sound accessory device that detects a direction of a sound source generating the external sound and transfers not only the external sound but also the direction of the sound source generating the external sound and an operating method of the sound accessory device. Through this, the user can hear a horn of a vehicle while listening to music by using the sound accessory device and recognize which direction the vehicle comes up to him/her in.

In addition, an embodiment provides a sound accessory device that receives an external sound necessary for the user and controls a volume of a sound output, stop or start of the sound output on the basis of the external sound, and an operating method of the sound accessory device.

In addition, an embodiment provides an operation method of a sound accessory device that receives an external sound necessary for a user, establishes a connection with an external device generating the external sound and releases a connection with another external device on the basis of the external sound. According to the embodiments, the user can hear notification from an external device through a sound accessory device without additional inputs to the sound accessory device. For example, if the user watches a TV using a sound accessory device and the sound accessory device receives mobile phone ringing sound, the sound accessory device can automatically release a connection to the TV and establish a connection to the mobile phone.

The details of one or more embodiments are set forth in the accompanying drawings and the description below. Other features will be apparent from the description and drawings, and from the claims.

DETAILED DESCRIPTION OF THE EMBODIMENTS

Figure 1:
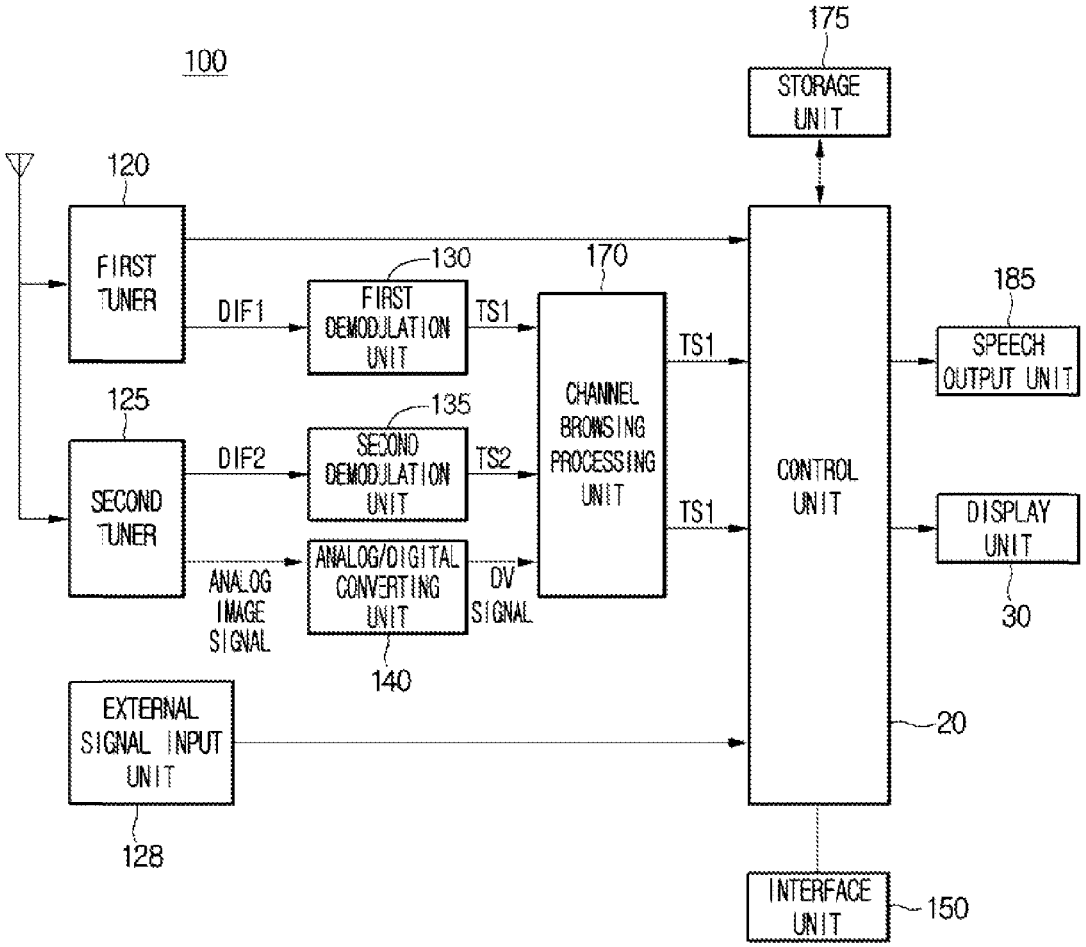
FIG. 1 is a block diagram illustrating a configuration of an image display device connected to a sound accessory device according to an embodiment.

Hereinafter, embodiments of the present invention will be described in detail with reference to the accompanying drawings so that the present invention can be easily realized by those skilled in the art. The present invention can be practiced in various ways and is not limited to the embodiments described herein. In the drawings, parts which are not related to the description are omitted to clearly set forth the present invention and similar elements are denoted by similar reference symbols throughout the specification.

In addition, if an element is referred to as "comprising" or "including" a component, it does not preclude another component but may further include the other component unless the context clearly indicates otherwise.

FIG. 1 is a block diagram illustrating a configuration of an image display device connected to a sound accessory device according to an embodiment.

Referring to FIG. 1, an image display device 100 may include a first tuner 120, a second tuner 125, an external signal input unit 128, a first demodulation unit 130, a second demodulation unit 135, an analog/digital converting unit 140, an interface unit 150, a control unit 20, a channel browsing processing unit 170, a storage unit 175, a display unit 30, and a speech output unit 185.

The first tuner 120 selects a radio frequency (RF) broadcast signal corresponding to a channel selected by a user among RF broadcast signals received through an antenna, and converts the selected RF broadcast signal into an intermediate frequency (IF) signal or a baseband image/speech signal.

For example, if the selected RF broadcast signal is a digital broadcast signal, the first tuner 120 converts it into a digital IF (DIF1) signal, and, if the selected RF broadcast signal is an analog broadcast signal, the first tuner 120 converts it into an analog baseband image/speech signal (CVBS 1/SIF). In other words, the first tuner 120 may be a hybrid tuner capable of processing digital and analog broadcast signals. It is also possible that the analog baseband image/speech signal (CVBS 1/SIF) output from the first tuner 120 is directly input to the control unit 20.

In addition, it is also possible that the first tuner 120 receives an RF broadcast signal with a single carrier according to an advance television systems committee (ATSC) scheme or an RF broadcast signal with a plurality of carriers according to a digital video broadcasting (DVB) scheme.

Similar to the first tuner 120, the second tuner 125 selects an RF broadcast signal corresponding a channel selected by a user among RF broadcast signals received through an antenna, and converts the selected RF broadcast signal into an IF signal or a baseband image/speech signal.

On the other hand, it is also possible that the second tuner 125 sequentially/periodically selects RF broadcast signals corresponding to all pre-stored broadcast signals through a channel memory function among RF broadcast signals received through the antenna, and converts them into IF signals or baseband image/speech signals. In an embodiment, since a pre-stored other channel image is displayed in a thumbnail type on at least a part of a screen, it is also possible to sequentially/periodically receive RF broadcast signals of all the pre-stored channels.

For example, it is possible that the first tuner 120 converts a main RF broadcast signal selected by the user into an IF signal or a baseband image/speech signal, and the second tuner 125 sequentially/periodically selects all RF broadcast signals (sub-RF broadcast signals) except the main RF broadcast signal or all RF broadcast signals and converts them into IF signals or baseband image/speech signals.

The first demodulating unit 130 receives the digital signal (DIF 1) converted by the first tuner 120 and performs a demodulation operation.

For example, if the digital IF signal (DIF 1) output from the first tuner 120 is in an ATSC scheme, the first demodulating unit 130 performs 8-vestigial side band (8-VSB) demodulation. Furthermore, the first demodulating unit 130 may also perform channel decoding.

To this end, the first demodulating unit 130 may include a Trellis decoder, a de-interleaver, and a Reed-Solomon decoder, and perform Trellis decoding, de-interleaving, and Reed-Solomon decoding.

For example, if the digital IF signal (DIF 1) output from the first tuner 120 is in a DVB scheme, the first demodulating unit 130 performs coded orthogonal frequency division modulation (COFDMA) demodulation. Furthermore, the first demodulating unit 130 may also perform channel decoding.

To this end, the first demodulating unit 130 may include a convolution decoder, a deinterleaver, and a Reed-Solomon decoder, and perform convolution decoding, deinterleaving and Reed-Solomon decoding.

The external signal input unit 128 performs a signal input to an external device. To this end, the external signal input unit 128 may include an A/V input and output unit and a wireless communication unit.

Furthermore, although the image display device 100 includes two tuners 120 and 125 in FIG. 1, embodiments are not limited hereto and it is also possible to include one or at least three tuners.

The external signal input unit 128 is connected to an external device such as a digital versatile disk (DVD) player, a Blu-ray disc player, a game player, a camcorder, or a computer (notebook), and delivers external input video, external input audio, and external input data signals to the control unit 20 inside the image display device 100. In addition, video, audio, and data signals processed in the control unit 20 may be output to another external device.

For inputting and outputting image/audio signals with an external device, the A/V input and output unit may include an Ethernet terminal, a USB terminal, a composite video banking sync (CVBS) terminal, a component terminal, an S-video (analog) terminal, a digital visual interface (DVI) terminal, a D-SUB terminal, an IEEE 1394 terminal, an SPDIF terminal, a liquid HO terminal, or a SCART terminal.

Although not illustrated in the drawing, various input signals input through the external signal input unit 128 are input to the channel browsing processing unit 170 to be described later and a thumbnail image extracting process may be performed thereon.

For example, an analog signal input through the CVBS terminal and the S-video terminal may be converted into a digital signal and input to the channel browsing processing unit 170 as described above. Digital signals input through other input terminals besides them may be directly input to the channel browsing processing unit 170 without analog/digital conversion.

Here, the digital signal output from the external signal input unit 128 may be a stream signal, and may be, for example, at least one selected from a MPEG-2 transport stream (TS), a MNT stream, and a MPEG-DASH stream into which MPEG-2 video and Dolby AC-3 audio are multiplexed.

The wireless communication unit may perform a wireless internet access. For example, for the wireless internet access, a wireless LAN (WLAN), Wi-Fi, Wireless broadband (Wi-Bro), World Interoperability for Microwave Access (Wi-max), and High Speed Downlink Packet Access (HSPA) may be used.

In addition, the wireless communication unit may perform short range communication with another electronic device. For example, Bluetooth, radio frequency Identification (RFID), infrared data association (IrDA), ultra wideband (UWB), and ZigBee may be used therefor.

Furthermore, the external signal input unit 128 may be connected to various set top boxes through at least one of various terminals and perform an input/output operation with the set top box.

For example, if the set top box is a set top box for internet protocol (IP) TV, image, speech, and data signals processed by the set top box for IPTV may be transferred to the control unit 20 or signals processed by the control unit 20 to the set top box for IPTV.

Furthermore, the image, speech, and data signals processed by the set top box for IPTV may be possibly processed by the control unit 20 via the channel browsing processing unit 170.

The foregoing IPTV may mean a TV including an ADSL-TV, a VDSL-TV, or FTTH-TV according to a kind of transmission network, and may mean a TV including a TV over DSL, a Video over DSL, a TV over IP (TVIP), or a Broadband TV (BTV). In addition, the IPTV may mean a TV including an internet TV accessible to the internet or a full browsing TV.

The first demodulating unit 130 may perform demodulation and channel decoding, and output a stream signal (TS-1). The stream signal (TS 1) at this time may be a signal into which video, audio and data signals are multiplexed. For example, the stream signal (TS 1) may be an MPEG-2 TS into which MPEG-2 video, H.264 video, HE-AVC video, MPEG1 audio, HE-AAC audio, Dolby AC-3 audio, and DTS audio are multiplexed. In detail, the MPEG-2 TS may include a 4-byte header and a 184-byte payload.

The stream signal (TS1) is input to the control unit 20, and is demulitplexed and signal-processed therein. In an embodiment, before being input to the control unit 20, the stream signal TS1 is input to the channel browsing processing unit 170 and processed for channel-browsing therein. The channel browsing operation is described later.

On the other hand, it is possible that the first demodulation unit 130 may be separately prepared according to the ATSC scheme and the DVB scheme. In other words, an ATSC demodulating unit and a DVB demodulating unit are separately prepared.

The second demodulating unit 135 receives the digital signal (DIF 2) converted by the second tuner 125, performs a demodulation operation, and outputs a stream signal (TS 2). The operation of the second demodulating unit 135 is omitted with reference to the operation of the first demodulating unit 130.

Furthermore, if a signal output from the second tuner 125 is an analog baseband image signal (CVBS 2), the signal is necessary to be converted into a digital signal by the analog/digital converting unit 140.

The analog/digital signal converting unit 140 converts an input analog signal into a digital signal. If the input signal is a video signal, the video signal is sampled and quantized and converted into a digital video (DV) signal. The converted digital signal may be a signal that has not been encoded. The converted digital video (DV) signal may be input to and processed by the channel browsing processing unit 170.

The interface unit 150 may transfer an input signal from the user to the control unit 20 or a signal from the control unit 20 to the user. For example, the interface unit 150 may receive user input signals such as a power on/off signal, a channel selection signal, and a screen setting signal from the remote controller 200 according to various communication schemes such as an RF communication scheme, an IR communication scheme, etc., or transmit a signal from the control unit 20 to the remote controller 200.

According to an embodiment, the interface unit 150 may include an operation recognition unit 10, recognize a motion of the user and output information thereon to the control unit 20.

The control unit 20 demultiplexes an input stream, signal-processes the demultiplexed signals, generating signals for image and speech outputs, and output the signals. Besides, the control unit 20 may control an overall operation inside the image display device 100.

Although not illustrated in the drawing, the control unit 20 may include a demultiplexing unit, an image processing unit, a speech processing unit, and a user input signal processing unit.

The control unit 20 may demultiplex an input stream signal, for example, an MPEG-2 TS, into video, audio, and data signals.

In addition, the control unit 20 may perform image-processing on the demultiplexed video signal. For example, if the demultiplexed video is an encoded video, the demultiplexed video may be decoded. In detail, if the demultiplexed video is an MPEG-2 encoded video, the demultiplexed video may be decoded by the MPEG-2 decoder. Furthermore, if the demultiplexed video is a H.264 encoded video according to a digital multimedia broadcasting scheme or a DVB-H scheme, the demultiplexed video may be decoded by a H.264 decoder.

Furthermore, the control unit 20 may process brightness, tint, and color adjustment of the video.

The video image-processed by the control unit 20 becomes input to the display unit 30 and displayed. In addition, it is possible that the video is input to an external output terminal connected to an external output device.

In addition, the control unit 20 may perform speech-processing on the demultiplexed audio. For example, if the demultiplexed audio is an encoded audio, the control unit 20 may decode the demutiplexed audio. In detail, if the demultiplexed audio is an MPEG-2 encoded audio, the demultiplexed audio may be decoded by the MPEG-2 decoder.

Furthermore, if the demultiplexed audio is an MPEG 4 bit sliced arithmetic coding (BSAC) encoded audio according to a terrestrial wave DMB scheme, the demultiplexed audio may be decoded by an MPEG-decoder. In addition, if the demultiplexed audio is MPEG 2 advanced audio codec (AAC) encoded audio according to a satellite DMB scheme or DVB-H scheme, the demultiplexed audio may be decoded by an AAC decoder.

Furthermore, the control unit 20 may process base, treble, or volume adjustment.

The audio processed by the control unit 20 is input to a speech output unit 185, for example, a speaker and output in a speech. In addition, it is also possible that the audio is input to an external output terminal connected to an external output device.

In addition, the control unit 20 may perform data-processing on the demultiplexed data signal. For example, if the demultiplexed data signal is an encoded data signal, the control unit 20 may decode the demutiplexed data signal. The encoded data signal may be electronic program guide (EPG) information including broadcast information such as a start time and an end time of a broadcast program broadcast through each channel.

For example, in case of the ATSC scheme, the EPG information may be ATSC-Program and System Information Protocol (TSC-PSIP) information, and, in case of the DVB scheme, the EPG information may include DVB-service information (DVB-SI). The ATSC-PSIP information or the DVB-SI information may be information included in the forgoing stream, namely, a header (4 bytes) of the MPEC-2 TS.

In addition, the control unit 20 may perform on screen display (OSD) processing. In detail, the control unit 20 may generate signals for displaying various pieces of information in graphic or text on a screen of the display unit 30 on the basis of at least one of image-processed video and a data-processed data signal, and a user input signal from the remote controller 200. The generated signal may be input to the display unit 30 together with the image-processed video and the data-processed data signal.

The signal generated for graphic or text display may include various data such as a user interface screen of the image display device 100, various menu screens, widgets, or icons.

Furthermore, the control unit 20 may perform a personal video recorder (PVR) function of recording a broadcast signal in the storage unit 175 and playing it. At this point, the control unit 20 may perform a scheduled recording function of performing recording at a pre-determined time. The control unit 20 may set the scheduled recording on the basis of time input by the user. Furthermore, the control unit 20 may set the scheduled recording on the basis of EPG information extracted from broadcast information such as DVB, SI, PSIP, or information received from a data server.

The control unit 20 may provide a time shifting function of playing currently being recorded broadcast signal while recording it.

The control unit 20 may provide a trick mode function. The trick mode function may include fast forward (FF) play of playing forward faster than a normal speed, fast rewind play of playing reversely faster than the normal speed, play, stop, forward slow motion play of playing forward slower than the normal speed, and rewind slow motion play of playing reversely slower than the normal speed. At this point, the fast forward play and the fast rewind play may be a scheme of playing all frames faster than a reference speed. Alternatively, the fast forward play and the fast rewind play may be a scheme of playing only a part of all the frames.

In addition, the control unit 20 may provide a skip play function moving to a specific time point. The skip play function may include a forward skip play moving to a specific time point of the forward direction and a reverse skip play moving to a specific time point of the reverse direction. In this specification, the forward skip play may be used as having the same meaning with forward jump, and the reverse skip play may be used as having the same meaning with backward jump.

Furthermore, the control unit 20 may provide a series recording function of setting scheduled recording for series including consecutive episodes of an identical TV program at a time. For example, if the user sets series recording for a specific TV series including episodes of 1 to 13 issues, the control unit 20 sets scheduled recording for all episodes of 1 to 13 issues. The control unit 20 may perform series recording on the basis of information extracted from broadcast information such as DVB, SI, PSIP, or information received from a data server. In a detailed embodiment, the control unit 20 may perform series recording on the basis of the title of a TV program. Alternatively, the control unit 20 may perform series recording on the basis of at least one of a group identifier and a content identifier of each TV program included in the broadcast information.

The channel browsing processing unit 170 may perform a browsing process on at least one of a broadcast signal corresponding to a received channel and various input videos input through the external signal input unit 128.

In detail, a new stream signal TSa may be output by receiving stream signals TS1 or TS2 demodulated and channel-decoded by the demodulating units 130 and 135, receiving a stream signal through the external input signal input unit 128, or receiving a digital signal (DV) converted by the analog/digital converting unit 140, demultiplexing the stream signal TS1 or TS2, extracting a part of the demultiplexed videos, and multiplexing the extracted videos. For example, the stream signal TSa or TSb may be an MPEG 2 TS.

Furthermore, the channel browsing processing unit 170 may output a main stream signal TSb corresponding to a main video displayed on a main region among videos displayed on the display unit 30 without an additional process, and may channel-browse and output a sub-stream signal TSa corresponding to a sub-video displayed on a sub-region among the videos displayed on the display unit 30 as described above.

In an embodiment, if a channel list is display on the display unit 30, a part of images of broadcast signals of a plurality of channels is extracted and re-encoded in a stream type, and at least a part of the broadcast signal images of the plurality of channels may be displayed on a screen in a thumbnail type. Accordingly, the user intuitively may know content that is broadcast through other channels.

The channel browsing processing unit 170 may extract a part of various external input images input through the external signal input unit 128 and re-encode in a stream type, and, if the external input list is displayed on the display unit 30, at least a part of externally input images from a plurality of external input devices may be displayed in a thumbnail type. Accordingly, the user may intuitively know content input from the plurality of external devices.

Furthermore, the channel browsing processing unit 170 may extract a part of the broadcast signal images and the externally input images and re-encode in a stream type, and, if the channel list and the external input list is displayed on the display unit 30, at least a part of broadcast signal images of a plurality of channels and externally input images from a plurality of external input devices may be displayed in a thumbnail type.

Accordingly, the user may intuitively know content input from the plurality of channels and the plurality of external input devices.

The storage unit 175 may store programs for processing and controlling each signal inside the control unit 20, and may store signal processed video, audio, and data signals.

In addition, the storage unit 175 may perform a function of temporarily storing images, speeches, or data signals input from the external signal input unit 128.

On the other hand, the storage unit 175 may store a corresponding broadcast channel through a channel memory function, and, to this end, may include at least one type of storage media including a flash memory type, a hard disk type, a multimedia card micro type, a card type memory (e.g., SD or XD memory, etc.), RAM, and ROM (e.g., EEPROM etc.).

In the drawing, the storage unit 175 is illustrated as separately prepared from the control unit 20, but it is not limited hereto and it is also possible to be prepared inside the control unit 20. In addition, the storage unit 175 may be a storage medium connected through an external input port.

Furthermore, the image display device 100 may play files (video files, still image files, music files, document files, etc.) stored in the storage unit 175, and provide them to the user.

The display unit 30 converts video, a data signal, an OSD signal processed in the control unit 20, or video, a data signal received from the external signal input unit 128 into R, G, and B signals, and generates a driving signal.

The display unit 30 may be implemented in various type including a PDP, an LCD, an OLED, a flexible display, or a 3D display. In addition, the display unit 30 may be configured with a touch screen and also be used as an input device other than an output device.

The speech output unit 185 receives a signal speech-processed by the control unit 20, for example, a stereo signal, a 3.1 channel signal, or a 5.1 channel signal, and outputs it in a speech. The speech output unit 185 may be implemented in various types of speakers.

The image display device 100, as a stationary type, may be a digital broadcast receiver that may receive at least one selected from digital broadcast of an ATSC scheme (8-VSB scheme), digital broadcast of a DVB-T scheme (COFDM scheme), and digital broadcast of an ISDB-T scheme (BST-OFDM scheme), and, as a mobile type, may be a digital broadcast receiver that may receive at least one selected from digital broadcast of a terrestrial DMB scheme, digital broadcast of a satellite DMB scheme, digital broadcast of an ATSC-M/H scheme, digital broadcast of a DVB-H scheme (a COFDM scheme), and digital broadcast of a media forward link only scheme. In addition, it may also be a digital broadcast receiver for cable, satellite communication, or IPTV.

Figures 2A, 2B, 2C:
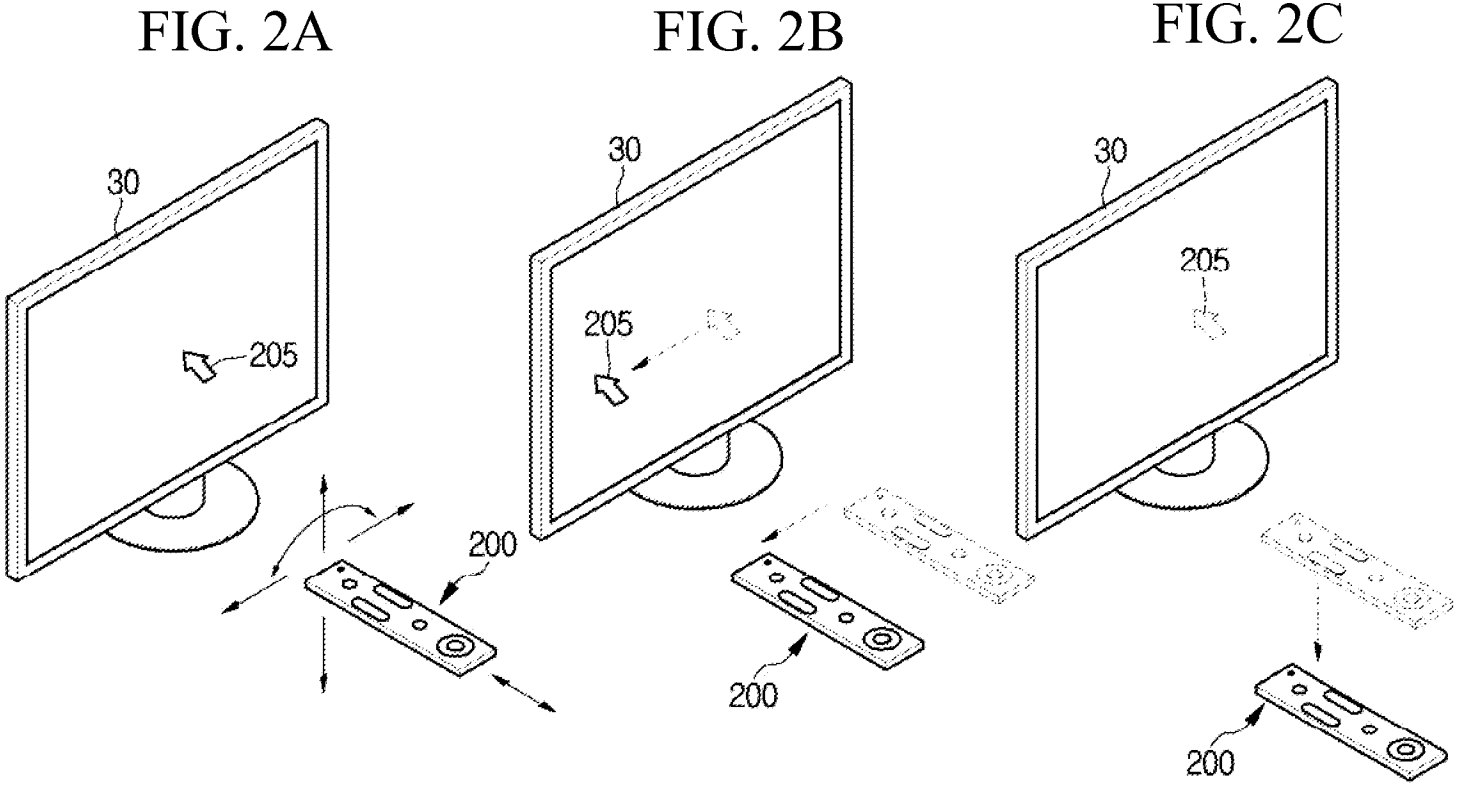
FIGS. 2A to 2C illustrate embodiments of a method of controlling an operation of an image display device connected to a sound accessory device using a remote control device.

FIGS. 2A to 2C illustrate embodiments of a method of controlling an operation of an image display device connected to a sound accessory device using a remote control device.

As illustrated in FIG. 2A, a pointer 205 corresponding to the remote controller 200 is exemplarily displayed on the display unit 30.

The user may move the remote controller 200 up and down and right and left, or rotate it. The pointer 205 displayed on the display unit 30 of the image display device 100 may correspond to a movement of the remote controller 200. As shown in the drawing, this remote controller 200 may be named as a spatial remote controller, since a corresponding pointer 205 is moved and displayed in a 3D space according to the movement of the remote controller 200.

FIG. 2B exemplarily illustrates that, if the user moves the remote controller 200 to the left, the pointer 205 displayed on the display unit 30 of the image display device 100 is correspondingly moved to the left.

Information on movement of the remote controller 200 detected through a sensor of the remote controller 200 is transmitted to the image display device 100. The image display device 100 may calculate a coordinate of the pointer 205 from the information on the movement of the remote controller 200. The image display device 100 may display the pointer 205 so as to correspond to the calculated coordinate.

FIG. 2C exemplarily illustrates a case where the user moves the remote controller 200 away from the display unit 20 with a specific button in the remote controller 200 pressed. Accordingly, a selection area in the display unit 30, which corresponds to the pointer 205, may be zoomed in and displayed as enlarged.

On the contrary, if the user moves the remote controller 200 close to the display unit 30, the selection area in the display unit 30, which corresponds to the pointer 205, may be zoomed out and displayed as contracted.

Furthermore, if the remote controller 200 is distant away from the display unit 30, the selection area may be zoomed out. If the remote controller 200 is close to the display unit 30, the selection area may be zoomed in.

In addition, in a state where a specific button in the remote controller 200 is pressed, recognition on up and down and right and left movement may be excluded. In other words, if the remote controller 200 is moved away from or close to the display unit 30, recognition may be allowed not for the up and down and left and right movement, but only for the forward and backward movement. In a state where a specific button in the remote controller 200 is not pressed, only the pointer 205 is moved according to the up and down and left and right movement of the remote controller 200.

Furthermore, a movement speed or a movement direction of the pointer 205 may correspond to that of the remote controller 200.

Furthermore, the pointer 205 herein means an object displayed on the display unit 20 in correspondence to an operation of the remote controller 200. Accordingly, objects having various shapes may be enabled besides an arrow shape illustrated as the pointer 205 in the drawing. For example, it may be a concept including a point, a curser, a prompt, a thick outline, etc. In addition, the pointer 205 may be displayed in correspondence to a plurality of points such as a line or a surface as well as to any one point of a horizontal axis and a vertical axis on the display unit 30.

With reference to FIGS. 3 to 7, description is provided about an operation that a sound accessory device receives a second sound and controls an operation of a first sound output on the basis of the second sound.

Figure 3:
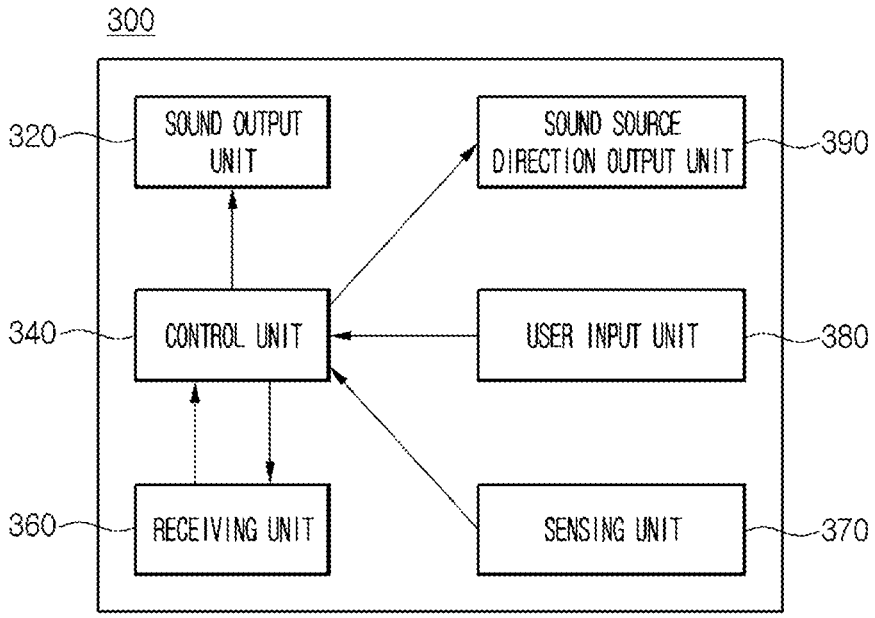
FIG. 3 is a block diagram illustrating a configuration of a sound accessory device according to an embodiment.

FIG. 3 is a block diagram illustrating a configuration of a sound accessory device according to an embodiment.

A sound accessory device 300 according to an embodiment includes a sound output unit 320, a control unit 340, a receiving unit 360, a user input unit 380, and a sound source direction output unit 390.

The receiving unit 360 receives a first sound from an external device connected to the sound accessory device 300. The receiving unit 360 may be connected to the external device in a wired manner or wirelessly through Bluetooth or a wireless LAN, etc.

In addition, the receiving unit 360 receives a second sound different from the first sound from outside. The receiving unit 360 may include a microphone for receiving the second sound.

The sound output unit 320 outputs a sound received by the receiving unit 360. In a detailed embodiment, the sound output unit 320 may amplify a sound received by the receiving unit 360 and output the amplified sound.

The control unit 340 controls an operation of the sound accessory device 300. In particular, the control unit 340 may set a sound for triggering a sound output control of the sound accessory device 300. In a detailed embodiment, the control unit 340 may set a sound for triggering a first sound output control of the sound accessory device 300 ob the basis of the user input. For example, if the second sound is received after the user input, the control unit 340 may set the second sound as the sound for triggering the sound output control of the sound accessory device 300.

In addition, the control unit 340 may determine a direction of a sound source generating the second sound. In order to detect the direction of the sound source generating the second sound, the sensing unit 370 may include a multi-channel microphone. At this point, the control unit 340 may detect the direction of the sound source by using the multi-channel microphone. In addition, the sensing unit 370 may include a beam forming microphone. At this point, the control unit 340 may detect the direction of the sound source by using a beam forming algorithm. A signal to noise ratio (SNR) of the received sound may be improved through the beam forming algorithm. In addition, in order to improve the direction detection, the control unit 340 may use a generalized sidelobe canceller algorithm together.

In a detailed embodiment, the sound for triggering the sound output control of the sound accessory device 300 may include a specific word, a voiceprint representing a speech of a specific person, a horn of a vehicle, an alarm sound notifying emergency such as fire, a notification sound of an external device, a sound of a pet, or a doorbell sound, etc. At this point, the notification sound of the external device may include a notification sound of a mobile terminal such as a mobile phone, a notification sound of a home appliance such as a gas stove, an oven, or a washer, a doorbell sound, or a sound of a pet. For example, if the sound for triggering the sound output control is a voiceprint of a child among voiceprints of specific people, the user may not miss the sound that the child calls the user while listening to music through the sound accessory device 300. Alternatively, if the sound for triggering the sound output control is a horn of a vehicle among horns of transportation means, the user may hear the horn from the vehicle while walking and listening to music through the sound accessory device 300. Accordingly, the sound accessory device 300 according to an embodiment may prevent an accident from being occurred, wherein the accident may occur since the user does not hear a horn of a vehicle. In addition, if the sound for triggering the sound output control is a ringtone of a mobile phone among notification sounds of the external devices, the user may hear the ringtone of the mobile phone through the sound accessory device 300 while watching TV. Accordingly, the sound accessory device 300 according to an embodiment may prevent the user from not hearing the ringtone of the mobile phone due to use of the sound accessory device 300. In addition, if the sound for triggering the sound output control is a notification sound of a washer among notification sounds of external devices, the user may hear the notification sound of the washer through the sound accessory device 300 while watching TV. Accordingly, the sound accessory device 300 according to an embodiment may prevent the user from not taking out the laundry from the washer in time due to use of the sound accessory device 300.

In addition, the control unit 340 may improve sensitivity of the second sound received by the receiving unit 360 by using signal processing of an acoustic echo canceller. Regarding this, description is provided in detail with reference to FIGS. 4 and 5.

The user input unit 380 receives a user input for the sound accessory device 300. In a detailed embodiment, the user input unit 380 may include a button for a user input. In addition, the user input unit 380 may include a speech module for recognizing a speech command of the user. At this point, the sound accessory device 300 may receive the speech command of the user. In addition, in a detailed embodiment, the user input unit 380 may receive a user input for setting the sound for triggering the sound output control. The user input unit 380 may receive a user input for setting the sound for triggering the sound output control, the receiving unit 360 may receive the second sound from outside, and the control unit 340 may set the second sound as the sound for the triggering the first sound output control. For example, if the user input unit 380 receives a user input for setting the sound for triggering the sound output control and the receiving unit 360 receives a baby's crying sound, the control unit 340 may set the baby's crying sound as the sound for the triggering the sound output control. In addition, the control unit 340 may cancel or change the sound for triggering the pre-set sound output control based on the user input.

The sound direction output unit 390 outputs a direction of a sound source generating the second sound to the user. At this point, the sound source output unit 390 may include a vibration motor and output the direction of the sound source by using the vibration motor. In a detailed embodiment, the sound source output unit 390 may output the direction of the sound source generating the second sound by using the number of times and location of consecutive vibrations. For example, if the sound source is in the right side of a sound output accessory, the sound source direction output unit 390 may generate vibration on the right side of the sound accessory device 300. Alternatively, if the sound source is in the right direction of the sound output accessory, the sound source direction output unit 390 generates vibration once. If the sound source is in the left direction of the sound output accessory, the sound source direction output unit 390 generates vibration twice. In another detailed embodiment, the sound source direction output unit 390 may output a direction of the sound source in a sound signal through the sound output unit 320. In detail, the sound direction output unit 390 may output the direction of the sound source by outputting a word indicating a direction through the sound output unit 320. For example, if a detected direction of the sound source is right rear, the sound source direction output unit 390 may output a speech "right rear" through the sound output unit 320. In another detailed embodiment, the sound source direction output unit 390 may include a light emitting diode and output the direction of the sound source by using the LED. In detail, the sound source direction output unit 390 may include a plurality of LEDs and allocate a plurality of LEDs to a plurality of sound source directions. At this point, the sound source direction output unit 390 may output the direction of the sound source by turning on the LEDs allocated to the detected sound source direction. For example, if the detected direction of the sound source is right rear, the sound source direction output unit 390 may output the direction of the sound source by turning on the LEDs positioned in the right side among the plurality of LEDs. Alternatively, the sound source direction output unit 390 may output the direction of the sound source by using the number of flickering times of the LED. In detail, the sound source direction output unit 390 may allocate the number of flickering times according to the direction of the sound source, and output the direction of the sound source by flickering the LED allocated to the detected direction of the sound source as many as the number of flickering times. Through this, the sound accessory device 300 according to a detailed embodiment may notify the user of a vehicle coming up to the user and the direction of the vehicle. Accordingly, the sound accessory device 300 according to a detailed embodiment may prevent a traffic accident from being occurred, wherein the traffic accident may occur since the user does not detect a vehicle coming up to the user and the horn of the vehicle.

Figure 4:
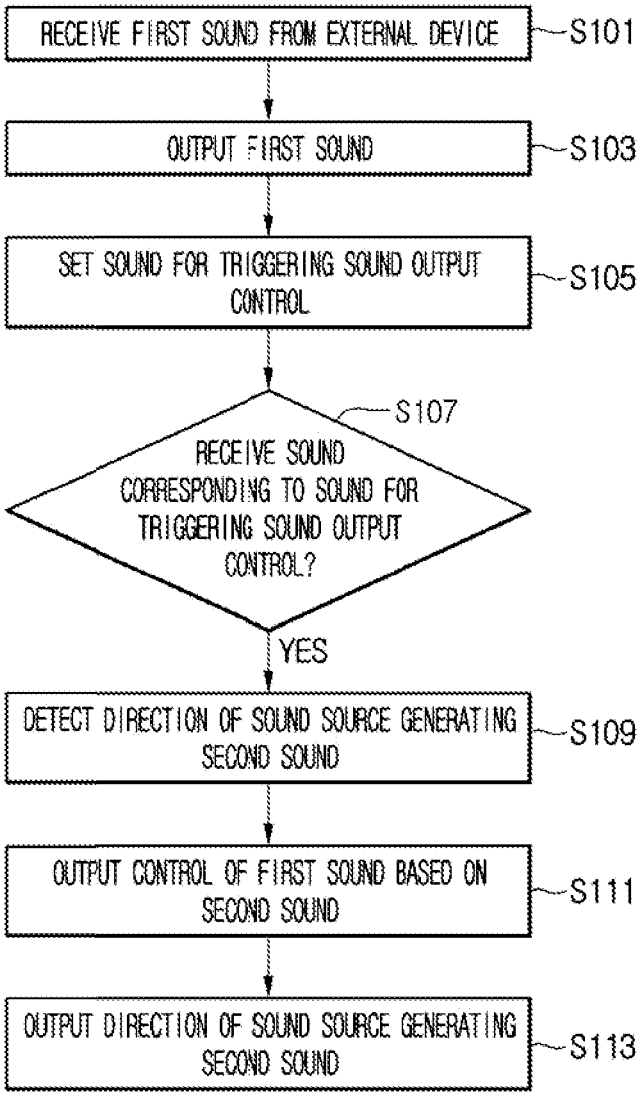
FIG. 4 is a flowchart illustrating an operation of a sound accessory device according to an embodiment.

FIG. 4 is a flowchart illustrating an operation of a sound accessory device according to an embodiment.

The receiving unit 360 receives the first sound from the external device (operation S101). At this point, the receiving unit 360 may be connected to the external device in a wired manner or wirelessly through Bluetooth or a wireless LAN, etc., as described above.

The sound output unit 320 outputs the first sound (operation S103). At this point, the sound output unit 320 may amplify the first sound and outputs the amplified first sound.

The control unit 340 sets the sound for triggering the sound output control (operation S105). At this point, the control unit 340 may set the sound for triggering the sound output control based on the user input. As described above, the user input unit 380 may receive the user input for setting the sound for triggering the sound output control, the receiving unit 360 may receive the second sound, and the control unit 340 may set the second sound as the sound for the triggering the first sound output control. For example, if the user input unit 380 receives a user input for setting the sound for triggering the sound output control and the receiving unit 360 receives a baby's crying sound, the control unit 340 may set the baby's crying sound as the sound for the triggering the sound output control. However, such a process may be omitted if the sound for triggering the sound output control is set at the time of production of the sound accessory device 300.

In addition, the sound for triggering the sound output control may include a specific word, a voiceprint representing the speech of a specific person, a horn of a vehicle, an alarm sound notifying emergency such as fire, a notification sound of an external device, a sound of a pet, or a doorbell sound. At this point, the notification sound of the external device may include a notification sound of a mobile terminal such as a mobile phone, a notification sound of a home appliance such as a gas stove, an oven, or a washer. For example, if the sound for triggering the sound output control is a voiceprint of a child among voiceprints of specific people, the user may not miss the sound that the child calls the user while listening to music through the sound accessory device 300. Alternatively, if the sound for triggering the sound output control is a horn of a vehicle among horns of transportation means, the user may hear the horn from the vehicle while walking and listening to music through the sound accessory device 300. Accordingly, the sound accessory device 300 according to an embodiment may prevent an accident from being occurred, wherein the accident may occur since the user does not hear a horn of a vehicle. In addition, if the sound for triggering the sound output control is a ringtone of a mobile phone among notification sounds of the external devices, the user may hear the ringtone of the mobile phone through the sound accessory device 300 while watching TV. Accordingly, the sound accessory device 300 according to an embodiment may prevent the user from not hearing the ringtone of the mobile phone due to use of the sound accessory device 300.

The receiving unit 360 receives the second sound for triggering the sound output control from outside (operation S107). In detail, the receiving unit 360 receives the second sound from outside. At this point, the second sound is different from the first sound received from the external device. The control unit 340 determines whether the second sound is the sound for triggering the sound output control. In detail, the control unit 340 may compare the sound for triggering the sound output control with the second sound. If characteristics of the second sound are similar by at least a predetermined ratio to those of the sound for triggering the sound output control, the control unit 340 may determine that the sound for triggering the sound output control is received. At this point, the characteristics of the sound may include at least any one selected from frequency characteristics, a zero crossing rate, average spectrum, spectral flatness, prominent tones across a set of bands, and a bandwidth. For example, if the characteristics of the second sound are similar by at least a predetermined percentage to that of the sound for triggering the sound output control, the control unit 340 may determine that the sound for triggering the sound output control is received. More specifically, if the sound for triggering the sound output control is a baby's crying sound and frequency characteristics of the second sound and the baby' crying sound are similar by at least a predetermined percentage, the control unit 340 may determine that the baby's crying sound is received. At this point, the control unit 340 may improve reception efficiency of the second sound by using signal processing of an acoustic echo canceller. Regarding this, detailed description is provided with reference to FIG. 5.

Figures 5, 6:
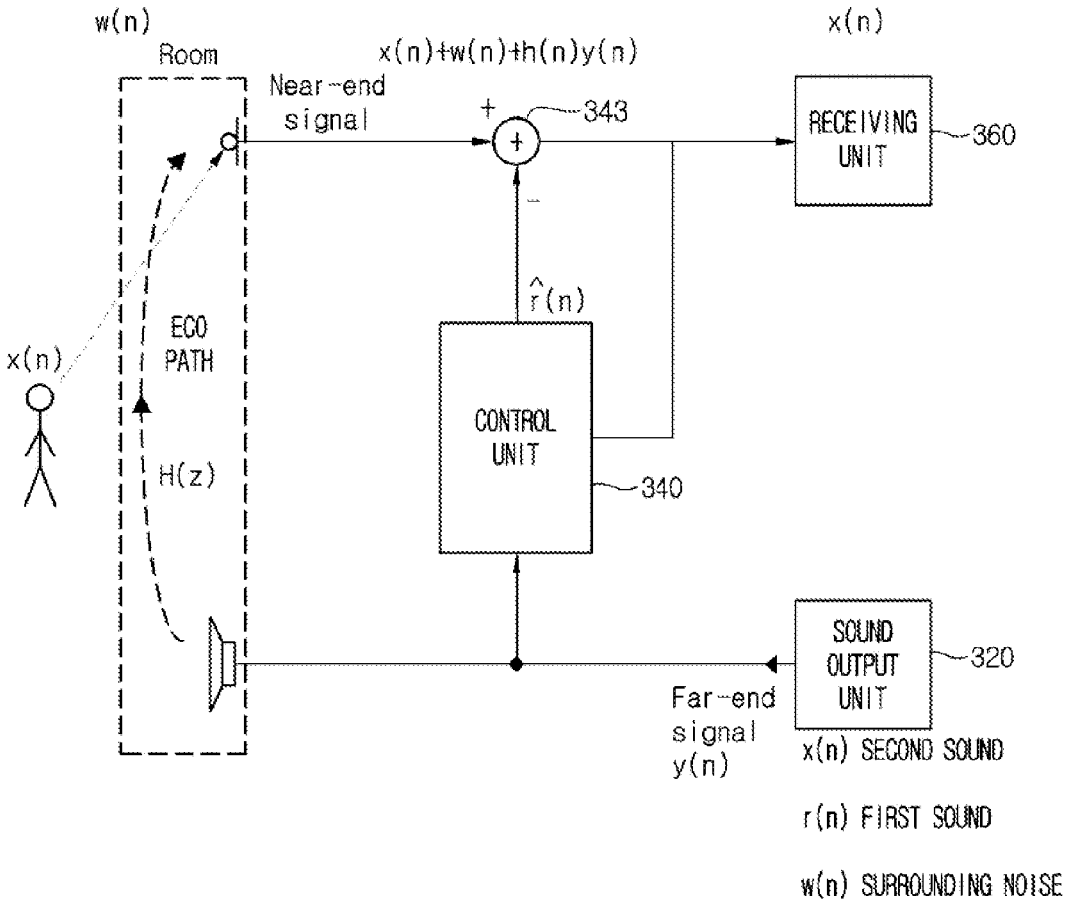
FIG. 5 is a view for explaining signal processing for improving second sound reception of a sound accessory device according to an embodiment.
FIG. 6 is a view for explaining that a sound accessory device makes sound output controls different according to a kind of second sound in a sound accessory device according to an embodiment.

FIG. 5 is a view for explaining a signal processing for improving reception of the second sound of the sound accessory device according to an embodiment.

If the second sound is received, the first sound output by the sound accessory device 300 may be received as the second sound. For preventing this, the signal processing of the acoustic echo canceller is used. The signal processing of the acoustic echo canceller refers to signal processing of improving reception efficiency of the second sound by removing the first sound output by a device receiving the sound from the received second sound. In FIG. 5, x(n) represents the second sound desired to be received by the sound accessory device 300, r(n) represents the first sound output by the sound accessory device 300, and w(n) represents surrounding noises. r(n), w(n), and x(n) are all synthesized and input to the receiving unit 360, while the sound output unit 320 outputs r(n). At this point, the control unit 340 may determine that r(n) output by the sound output accessory is also included in the second sound. Accordingly, for preventing this, the control unit 340 includes a synthesizing unit 343. The synthesizing unit 343 removes r(n) from the sound input to the sound accessory device 300 and transfers the remaining sound that r(n) is removed to the receiving unit 360. Accordingly, the control unit 340 may efficiently receive the second sound x(n) without being affected by r(n) that is output by the sound output unit 320. For example, if the sound output unit 320 outputs music received from an external device and the sound for triggering the sound output control is ringtone of a mobile phone, the control unit 340 may remove the sound corresponding to the music being currently played from sounds flowed into the sound accessory device and determine characteristics of the remaining sound is similar to the ringtone characteristic of the mobile phone.

If the second sound received by the receiving unit 360 is the sound for triggering the sound output control, the controller 340 detects a direction of a sound source generating the second sound (operation S109). The sound accessory device 300 may include a multi-channel microphone. At this point, the control unit 340 may detect the direction of the sound source by using the multi-channel microphone. In addition, the sound accessory device 300 may include a beam forming microphone. At this point, the control unit 340 may detect the direction of the sound source by using a beam forming algorithm. A signal to noise ratio (SNR) of the second sound may be improved through the beam forming algorithm. In addition, in order to improve the direction detection, the control unit 340 may use a generalized sidelobe canceller algorithm together.

The control unit 340 controls an output of the first sound output to the sound output unit 320 on the basis of the second sound (operation S111). In a detailed embodiment, the control unit 340 may stop the first sound output by the sound output unit 320. According to stop of the first sound output through the sound output unit 320, the user may hear the second sound. At this point, the control unit 340 may resume the stopped first sound output after a predetermined time has passed. At this point, the control unit 340 may continuously determine whether the second sound received by the receiving unit 360 is the sound for triggering the sound output control. If the receiving unit 360 does not receive the second sound for triggering the sound output control any more, the control unit 340 may resume the stopped first sound output. For example, if the sound output unit 320 outputs music received from an external device, the sound for triggering the sound output control is a doorbell sound, and the second sound received by the receiving unit 360 is a sound corresponding to the doorbell sound, the control unit 340 may stop the output of the music. At this point, if the sensing unit 370 does not receive the sound corresponding to the doorbell sound any more, the control unit 340 may re-output the stopped music.

In a detailed embodiment, the control unit 340 may decrease the output volume of the first sound of the sound output unit 320. According to the decrease of the sound output volume through the sound output unit 320, the user may hear the second sound. At this point, the control unit 340 may decrease the sound output volume by a predetermined size. Alternatively, the control unit 340 may decrease the sound output volume through the sound output unit 320 on the basis of the size of the second sound. In detail, the control unit 340 may decrease the size of the first sound output smaller than the size of the received second sound. For example, if the sound output unit 320 is outputting music received form the external device, the sound for triggering the sound output control is a baby's crying sound, and the second sound is a sound corresponding to the baby's crying sound, the control unit 340 may decrease the volume of the sound output to a degree that the user may hear the baby's crying sound.

In another detailed embodiment, the control unit 340 may output the second sound through the sound output unit 320. At this point, the control unit 340 may simultaneously output the first and second sounds according to embodiments. At this point, the control unit 340 may set an output volume of the second sound differently from that of the first sound. In detail, the control unit 340 may set the output volume of the second sound smaller than that of the first sound. For example, if the sound output unit 320 outputs music received from the external device, the sound for triggering the sound output control is a sound of a pet, and a sound corresponding to the pet sound is received, the pet sound received by the sound output unit 320 from outside and the music may be simultaneously output through the sound output unit 320. At this point, the output volume of the pet sound may be larger than the music output volume. Alternatively, the control unit 340 may output only the second sound. For example, if the sound output unit 320 outputs music received from the external device, the sound for triggering the sound output control is a sound of a pet, and a sound corresponding to the pet sound is received, only the pet sound received by the sound output unit 320 from outside may be output through the sound output unit 320.

In another detailed embodiment, the control unit 340 may store the second sound. In a detailed embodiment, the control unit 340 may play the stored second sound. At this point, the controller 340 may play the stored second sound on the basis of a user input. For example, if the sound output unit 320 outputs the music received from outside, the sound for triggering the sound output control is a voiceprint representing a speech of a specific person, and a sound corresponding to the voiceprint of the specific person is received, the control unit 340 may store the voice of the specific person. Alternatively, if there is a user input, the control unit may play the voice of the specific person.

In another detailed description, the sound accessory device 300 may set the sound for triggering the sound output control. The control unit 340 may control a sound output according to a kind of the sound for triggering each sound output control. Regarding this, detailed description is provided with reference to FIG. 6.

FIG. 6 is a view for explaining that a sound accessory device makes sound output controls different according to a kind of the second sound in a sound accessory device according to an embodiment.

As described above, the sound accessory device 300 may set the sound for triggering a plurality of sound output controls and the control unit may control the sound output according to the kind of the second sound. In detail, the control unit 340 may determine one of a plurality of sound output control schemes according to the kind of the second sound. The control unit 340 may control the sound output according to the determined sound output control scheme. At this point, the plurality of output control schemes may be different from each other. Operations that the user selects may be differed according to the importance of the second sound and the kind of the second sound. Accordingly, if the control unit 340 makes the sound output differed according to the kind of the second sound, user's convenience may be improved. For example, the baby's crying sound may be more important than any other sounds to the user, and the pet sound may have relatively low importance. In the embodiment illustrated in FIG. 6, the sound accessory sound 300 may set the baby's crying sound, the pet sound, and a doorbell sound as the sound for triggering the sound output control. In the embodiment if FIG. 6, if the second sound is the baby's crying sound, the control unit 340 outputs only the second sound through the sound output unit 320. In the embodiment if FIG. 6, if the second sound is the pet sound, the control unit 340 simultaneously outputs the first sound and the second sound through the sound output unit 320. In the embodiment if FIG. 6, if the second sound is the doorbell sound, the control unit 340 stops the first sound output through the sound output unit 320.

In another detailed embodiment, the control unit 340 may control the sound output by controlling the connection with the external device and release. Regarding this, detailed description is provided with reference to FIG. 7.

Figure 7:
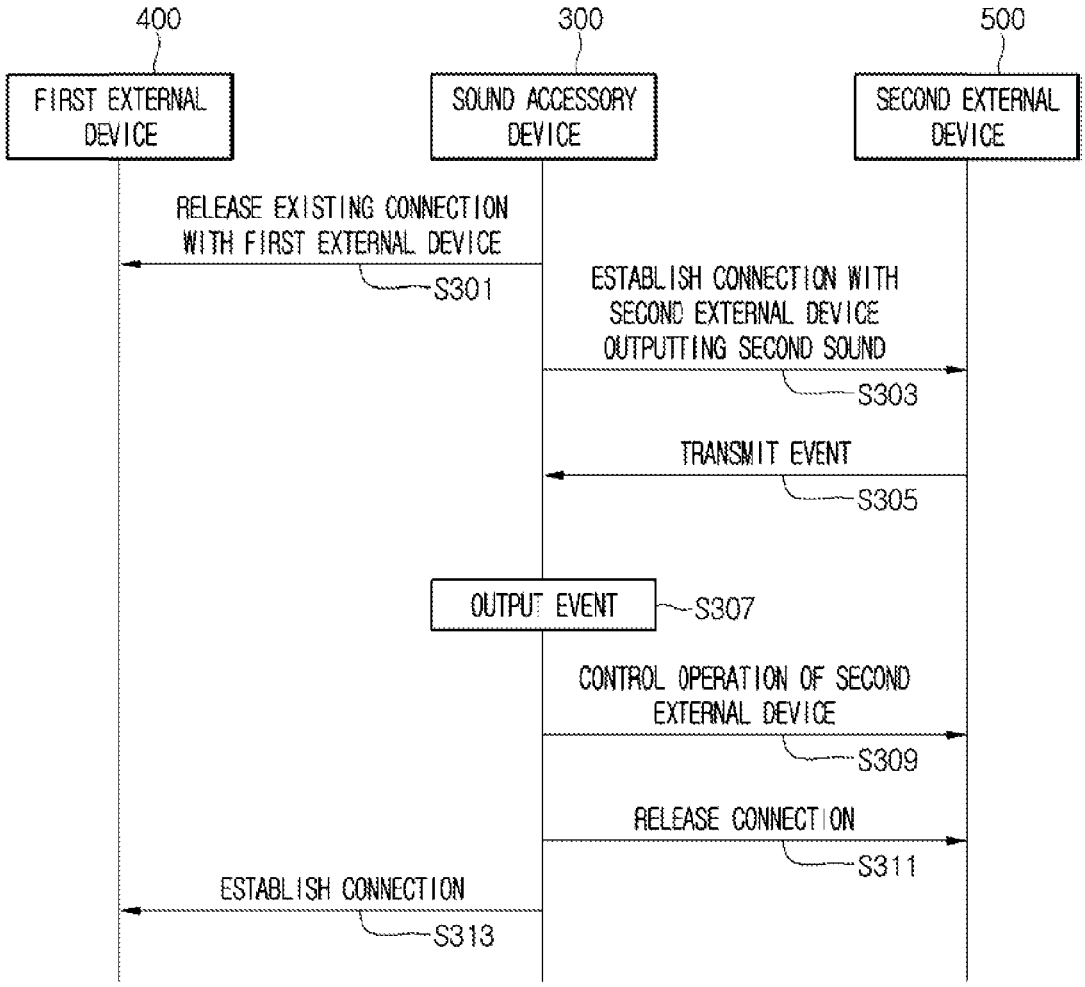
FIG. 7 illustrates that a sound accessory device according to an embodiment interlocks with an external device.

FIG. 7 illustrates that a sound accessory device according to an embodiment interlocks with an external device.

In the embodiment in FIG. 7, a first external device 400 is an external device connected to the sound accessory device 300. The sound accessory device 300 receives a sound from the first external device 400 and output it.

If the receiving unit 360 receives the second sound for triggering the sound output control, the control unit 340 releases a connection with the first external device 400 (operation S301).

Then the control unit 340 sets a connection with a second external device 500 outputting the second sound. For example, if the sound for triggering the sound output control is a ringtone of the mobile phone, the control unit 340 may set a connection with the mobile phone. Alternatively, if the sound for triggering the sound output control is a notification sound for TV power on, the control unit 340 may establish a connection to the TV. Alternatively, if the sound for triggering the sound output control is a doorbell sound, the control unit 340 may establish a connection with an interphone.

At this point, the first and second external devices 400 and 500 may be an image display device including a TV, a mobile terminal including a mobile phone, a home appliance including a washer, or a refrigerator, or a computer to which the sound accessory device 300 may establish a connection.

The second external device 500 transmits an event occurred therein to the sound accessory device 300 (operation S305). At this point, the second external device 500 may transmit a kind and content of the event to the sound accessory device 300. For example, if the second external device 500 is a mobile phone, at least any one selected from whether to receive a call, reception of a text message, and an alarm may be transmitted as the event. In addition, at this time, the second external device 500 may transmit together with the name of the call originator in the case of call reception, or content of the text message in the case of text message reception. For example, if the external device 500 is an image display device like a TV, at least any one selected from scheduled recording start or end, scheduled viewing, finish of a TV program, start of the TV program, and breaking news may be transmitted as the event. In addition, at this time, the second external device 500 may transmit together with scheduled recording start or end, a target program in case of the scheduled viewing, and content of news in case of the breaking news. In addition, the second external device 500 may convert the event into a speech signal and transmit the speech signal. For example, if the second external device 500 is a mobile phone, the second external device 500 may convert content of the received text message into a speech signal and transmit the speech signal to the sound accessory device 300. For example, if the second external device 500 is a TV, the second external device 500 may convert content of the breaking news into a speech signal and transmit the speech signal to the sound accessory device 300. In addition, the second external device 500 may transmit the event in a text file type.

The control unit 340 may receive an event and output the event to the user (operation S307). The control unit 340 may output the kind and content of the event. In a detailed embodiment, the control unit 340 may output the event in a speech signal through the sound output unit 320. For example, if the second external device 500 is a mobile phone and a received event is call reception, the control unit 340 may output information on the call originator and a fact that the call is received in a speech signal through the sound output unit 320. In addition, if the second external device 500 is a mobile phone and a received event is text message reception, the control unit 340 may output content of the text message in a speech signal through the sound output unit 320. Furthermore, if the second external device 500 is a TV and a received event is breaking news, the control unit 340 may output content of the breaking news in a speech signal through the sound output unit 320. Furthermore, if the second external device 500 is a TV and a received event is start or end of a program, the control unit 340 may output the name of the started or ended program in a speech signal through the sound output unit 320. Furthermore, if the second external device 500 is a TV and a received event is start or end of scheduled recording, the control unit 340 may output the name of the corresponding program of the scheduled recording in a speech signal through the sound output unit 320.

According to a detailed embodiment, the control unit 340 may control the operation of the second external device 500 on the basis of the event (operation S309). In a detailed embodiment, the control unit 340 may control the second external device 500 on the basis of a user input and an event received through the user input unit 380. For example, if the second external device 500 is a mobile phone, and the received event is a call reception, the control unit 340 may control the mobile phone so as to connect a call. In detail, if the second external device 500 is a mobile phone, the received event is a call reception, and a user input is received for this, the control unit 340 may control the mobile phone so as to connect a call. Alternatively, if the second external device 500 is a TV and the received event is a start of scheduled recording, the control unit 340 may control the TV so as to end the scheduled recording. In detail, if the second external device 500 is a TV, the received event is a start of scheduled recording, and there is a user input, the control unit 340 may control the TV so as to end the scheduled recording.

The control unit 340 releases the connection with the second external device 500 (operation S311). In a detailed embodiment, if an output of the received event from the second external device 500 is ended, the control unit 340 may release the connection with the external device 500. In another detailed embodiment, the control unit 340 may release the connection with the second external device 500 on the basis of the user input. In detail, the control unit 340 may release the connection with the second external device 500 having the user input for connection release from the second external device 500.

The control unit 340 established a connection with the first external device 400 (operation S313). In a detailed embodiment, if the connection with the second external device 500 is released, the control unit 340 may establish the connection with the first external device 400. In another detailed embodiment, the control unit 340 may establish the connection with the first external device 400 on the basis of the user input. In detail, if there is the user input for connection establishment with the first external device 400, the control unit 340 may establish the connection with the first external device 400.

Referring to FIG. 4 again, description about an operation of the sound accessory device 300 is provided.

The control unit 340 outputs the direction of the sound source generating the second sound through the sound output unit 320 (operation S113). The sound source direction output unit 390 may include a vibration motor and output the direction of the sound source by using the vibration motor. In a detailed embodiment, the sound source direction output unit 390 may output the direction of the sound source generating the second sound by using the number of times and location of consecutive vibrations. For example, if the sound source is in the right side of a sound output accessory, the sound source direction output unit 390 may generate vibration on the right side of the sound accessory device 300. Alternatively, if the sound source is in the right direction of the sound output accessory, the sound source direction output unit 390 generates vibration once. If the sound source is in the left direction of the sound output accessory, the sound source direction output unit 390 generates vibration twice. In another detailed embodiment, the sound source direction output unit 390 may output the direction of the sound source in a sound signal through the sound output unit 320. In detail, the sound direction output unit 390 may output the direction of the sound source by outputting a word indicating a direction through the sound output unit 320. For example, if a detected direction of the sound source is a rear right, the sound source direction output unit 390 may output a speech signal, "rear right", through the sound output unit 320. In another detailed embodiment, the sound source direction output unit 390 may include an LED and output the direction of the sound source by using the LED. In detail, the sound source direction output unit 390 may include a plurality of LEDs and allocate a plurality of LEDs to a plurality of sound source directions. At this point, the sound source direction output unit 390 may output the direction of the sound source by turning on the LEDs allocated to the detected sound source direction. For example, if the detected direction of the sound source is a rear right, the sound source direction output unit 390 may output the direction of the sound source by turning on the LEDs positioned in the right side among the plurality of LEDs. Alternatively, the sound source direction output unit 390 may output the direction of the sound source by using the number of flickering times of the LED. In detail, the sound source direction output unit 390 may allocate the number of flickering times according to the direction of the sound source, and output the direction of the sound source by flickering the LED allocated to the detected direction of the sound source as many as the number of flickering times. Through this, the sound accessory device 300 according to a detailed embodiment may notify the user of a vehicle coming up to the user and the direction of the vehicle. Accordingly, the sound accessory device 300 according to a detailed embodiment may prevent a traffic accident from being occurred, wherein the traffic accident may occur since the user does not detect a vehicle coming up to the user and the horn of the vehicle.

Figure 8:
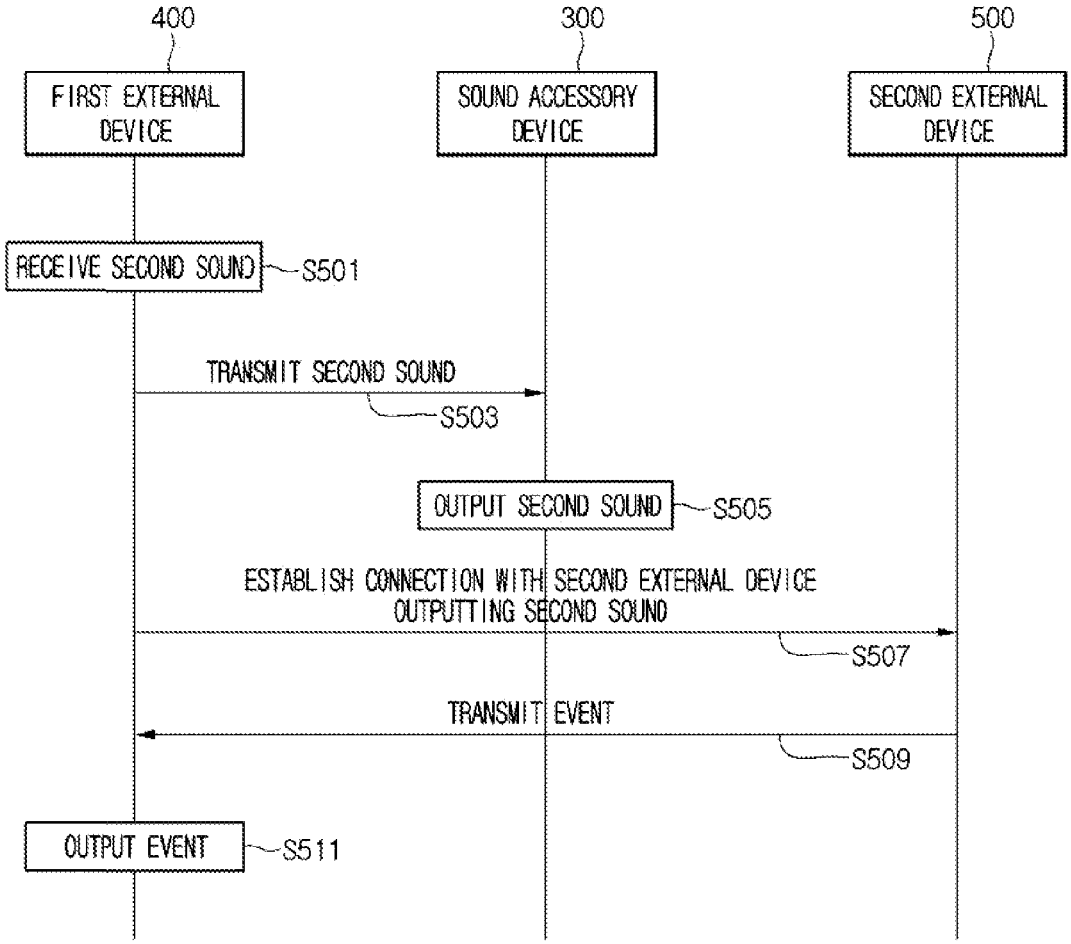
FIG. 8 illustrates that a sound accessory device according to another embodiment interlocks with an external device.

FIG. 8 illustrates that a sound accessory device according to another embodiment interlocks with an external device.

In the embodiment in FIG. 8, the first and second external devices 400 and 500 may be an image display device including a TV, a mobile terminal including a mobile phone, a home appliance including a washer, or a refrigerator, or a computer that the sound accessory device 300 may establish a connection.

In the embodiment in FIG. 8. a first sound is a sound that the sound accessory device 300 is currently outputting. In addition, the second sound is a sound output by the second external device.

The first external device 400 receives the second sound from outside, and determines whether the second sound is a sound for triggering a pre-determined sound output control. For example, if the first external device is a TV and the sound for triggering the sound output control is ringtone of a mobile phone, the TV may determine whether the second sound is a sound corresponding to the ringtone of the mobile phone.

The first external device 400 transmits the second sound to the sound accessory device 300 (operation S503). Accordingly, the sound accessory device 300 receives the second sound. For example, if the first external device is a TV and the sound for triggering the sound output control is a ringtone of a mobile phone, the TV may transmit the second sound corresponding to the ringtone of the mobile phone to the sound accessory device 300.

The sound accessory device 300 outputs the second sound (operation S505). For example, if the first external device is a TV and the sound for triggering the sound output control is a ringtone of a mobile phone, the sound accessory device 300 may output the second sound corresponding to the ringtone of the mobile phone. At this point, in a detailed embodiment, the sound accessory device 300 may stop an output of the first sound being currently output.

A connection is established with the second external device outputting the second sound (operation S507). For example, if the first external device is a TV and the sound for triggering the sound output control is ringtone of a mobile phone, the TV may establish a connection with the mobile phone. In a detailed embodiment, the first external device 400 may establish a connection with the second external device 500 on the basis of a user input for the sound accessory device 300. For example, if a headphone receives, from the user, a button input for a connection between the TV which is the first external device 400 and the mobile phone which is the second external device 500, the headphone may allow the TV to establish the connection with the mobile phone.

The second external device 500 transmits an event occurred in the second external device 500 (operation S509). At this point, the second external device 500 may transmit a kind and content of the event. Accordingly, the first external device 400 receives the event occurred in the second external device 500. At this point, the first external device 400 receives the kind and content of the event occurred in the second external device 500. At this point, if the second external device 500 is a mobile phone, the event may be any one selected from whether to receive a call, reception of a text message, and an alarm. If the external device 500 is an image display device like a TV, the event may be any one selected from scheduled recording start or end, scheduled viewing, finish of a TV program, start of the TV program, and breaking news. In addition, the second external device 500 may convert the event into a speech signal and transmit the speech signal. For example, if the second external device 500 is a mobile phone, the second external device 500 may convert content of the received text message into a speech signal and transmit the speech signal. If the second external device 500 is a TV, the second external device 500 may convert content of the breaking news into a speech signal and transmit the speech signal. In addition, the second external device 500 may transmit the event in a text file type.

The first external device 400 outputs the event (operation S511). For example, if the first external device 400 is a TV, the second external device 500 is a mobile phone, and the event is call reception, the TV may output call reception information on the mobile phone such as the call originator on an image display screen. For example, if the external device 400 is a TV, the second external device 500 is a mobile phone, and the event is text message reception, the TV may output content of the text message such as the originator on the image display screen, or convert the content of the text message into a speech signal, and transmit the speech signal to the sound accessory device 300.

In the foregoing, features, structures, or effects described in connection with embodiments are included in at least one embodiment, and are not necessarily limited to one embodiment. Furthermore, the exemplified features, structures, or effects in various embodiments can be combined and modified by those skilled in the art. Accordingly, contents in relation to these combination and modification should be construed to fall in the scope of the present invention.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A portable sound device comprising:

a receiver for receiving sound;

a sound outputter for outputting sound; and a controller operably coupled to the receiver and the sound outputter and configured to:

cause the sound outputter to output a first sound in response to an input received from a first external device that is physically or wirelessly coupled to the portable sound device to establish communication;

recognize a second sound that is received via the receiver from an external environment or a second external device while the first sound is output, wherein the second sound comprises at least one of a specific word, a voiceprint representing a speech of a specific person, a horn of a vehicle, an alarm sound, a notification sound of an external device, a sound of an animal or a doorbell sound; and cause the sound outputter to stop outputting the first sound selectively based on a type of the received second sound such that:

both the first sound and the second sound are output in response to a first type of the second sound; and the outputting of the first sound is stopped in response to a second type of the second sound.

2. The portable sound device according to claim 1, wherein the controller is further configured to cause the sound outputter to resume the outputting of the first sound when the second sound is no longer received by the receiver.

3. The portable sound device according to claim 1, wherein the controller is further configured to cause the sound outputter to output the second sound in response to the second type of the second sound.

4. The portable sound device according to claim 1, wherein an output volume of the second sound is greater than an output volume of the first sound when both the first sound and the second sound are output via the sound outputter.

5. The portable sound device according to claim 1, wherein in response to the second sound received via the receiver, the controller is further configured to:

stop communicating with the first external device; and establish communication with the second external device outputting the second sound.

6. The portable sound device according to claim 1, further comprising:

a sensor configured to sense a direction of a sound source generating the second source; and a sound direction outputter configured to output the direction of the sound source, wherein the controller is further configured to cause the sound direction outputter to output the direction of the sound source based on information about the direction sensed via the sensor.

7. An operating method of a portable sound device, the method comprising:

outputting, via a sound outputter, a first sound in response to an input received from a first external device that is physically or wirelessly coupled to the portable sound device to establish communication;

recognize a second sound that is received via a receiver from an external environment or a second external device while the first sound is output, wherein the second sound comprises at least one of a specific word, a voiceprint representing a speech of a specific person, a horn of a vehicle, an alarm sound, a notification sound of an external device, a sound of an animal or a doorbell sound; and stopping the outputting of the first sound selectively based on a type of the received second sound such that:

both the first sound and the second sound are output in response to a first type of the second sound; and the outputting of the first sound is stopped in response to a second type of the second sound.

8. The operating method according to claim 7, further comprising resuming the outputting of the first sound when the second sound is no longer received by the receiver.

9. The operating method according to claim 7, further comprising outputting, via the sound outputter, the second sound in response to the second type of the second sound.

10. The operating method according to claim 7, wherein an output volume of the second sound is greater than an output volume of the first sound when both the first sound and the second sound are output via the sound outputter.

11. The operating method according to claim 7, wherein in response to the second sound received via the receiver, the method further comprises:

stopping communicating with the first external device; and establishing communication with the second external device outputting the second sound.

12. The operating method according to claim 7, further comprising:

sensing a direction of a sound source generating the second sound; and outputting, via the sound outputter, the direction of the sound source based on information about the sensed direction.

* * * * *